United States Patent [19]

Fellner

[11] Patent Number: 4,949,481

[45] Date of Patent: Aug. 21, 1990

[54] DIGGING TOOTH ASSEMBLY

[75] Inventor: Ronald W. Fellner, Dubuque, Iowa

[73] Assignee: Deere & Company, Moline, Ill.

[21] Appl. No.: 389,655

[22] Filed: Aug. 4, 1989

[51] Int. Cl.[5] ..... E02F 5/00

[52] U.S. Cl. ..... 37/141 T; 37/142 R; 37/141 R; 37/142 A; 172/713; D15/29

[58] Field of Search ..... 37/141 R, 141 T, 142 R, 37/142 A; 172/713, 772; D15/29

[56] References Cited

U.S. PATENT DOCUMENTS

| | | | |
|---|---|---|---|
| D. 284,010 | 5/1986 | Voyce | D15/29 |
| 3,121,289 | 2/1964 | Eyolfson | 37/142 R |
| 3,312,504 | 4/1967 | Mäkinen | 37/142 A X |
| 3,729,845 | 5/1973 | Fuppin | 37/142 A |
| 3,959,901 | 6/1976 | Klett | 37/142 R |
| 4,123,861 | 11/1978 | Hemphill . | |
| 4,136,469 | 1/1979 | Zepf | 37/142 R X |
| 4,231,173 | 11/1980 | Davis | 37/142 R |
| 4,251,933 | 2/1981 | Hemphill . | |
| 4,321,762 | 3/1982 | Hemphill . | |
| 4,324,057 | 4/1982 | White | 37/142 A |
| 4,470,210 | 9/1984 | Hahn . | |
| 4,616,433 | 10/1986 | Knell et al. . | |
| 4,642,920 | 2/1987 | Lenhoff . | |
| 4,748,754 | 6/1988 | Schwappach | 37/142 A X |
| 4,761,900 | 8/1988 | Emrich | 37/142 R |

OTHER PUBLICATIONS

John Deere Parts Catalog; pp. 65 & 67.

John Deere Operator's Manual for John Deere 310C Backhoe Loader, p. 39.

*Primary Examiner*—Dennis L. Taylor

*Assistant Examiner*—J. Russell McBee

[57] ABSTRACT

A digging tooth for a bucket having a concave top surface and a convex bottom surface which intersect forming a forward cutting edge. Sidewalls connect the two surfaces and are concave having a moldboard shape. The rear portion of the tooth is provided with a mounting assembly for mounting it to a bucket. The bottom surface continuously diverges from the forward cutting edge to the rear portion; whereas the top surface first converges then diverges from the forward cutting edge to the rear portion.

1 Claim, 2 Drawing Sheets

DIGGING TOOTH ASSEMBLY

BACKGROUND OF THE INVENTION

1. Field of the Invention:

The invention is directed to improved digging teeth which may be mounted on backhoe, excavator and/or loader buckets.

2. Description of the Prior Art:

Modern backhoes and excavators are designed to move a bucket through an arcuate path when digging. In addition the cutting angle of the bucket can be adjusted by manipulating the bucket hydraulic cylinder during a digging operation. Bucket teeth maybe added to the bucket to aid in the digging operation.

Traditionally digging teeth have a wedge shaped configuration. However over the years many different configurations of digging teeth have been proposed. U.S. Pat. No. 4,642,920 discloses digging teeth having a wedge-shaped configuration and concave sides sidewalls. U.S. Pat. No. 4,321,762 discloses digging teeth having sloped sidewalls. U.S. Pat. Nos. 4,123,861, 4,251,933 and 4,470,210, and U.S. Design Pat. No. 284,010 disclose other digging teeth configurations.

SUMMARY

It is an object of the present invention to provide a digging tooth configuration that more easily moves through material thereby increasing the efficiency of the digging bucket to which it is attached.

The digging tooth of the present invention comprises concave top surface and a convex bottom surface that intersect forming a forward cutting edge. The concave top surface grossly approximates the digging arc of the bucket. The concave bottom surface provides material relief. Both sidewalls of the cutting tooth have a concave or moldboard shape. The top surface as defined by the top-side edges formed by the sidewalls with the top surface is hourglass shaped. More specifically, proceeding from the forward cutting edge to the rear portion of the digging tooth, the top-side edges initially converge and then diverge.

The bottom surface as defined by the bottom-side edges formed by the sidewalls with the bottom surface continuously diverge as they proceed from the forward cutting edge to the rear portion of the digging tooth.

DETAILED DESCRIPTION

Figure 1:
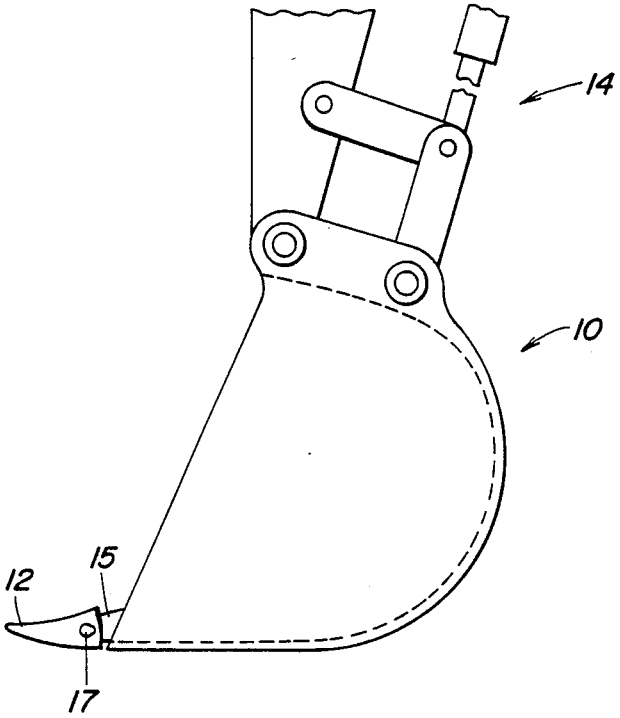
FIG. 1 is a side view of a digging bucket provided with the digging teeth of the present invention.
Figure 2:
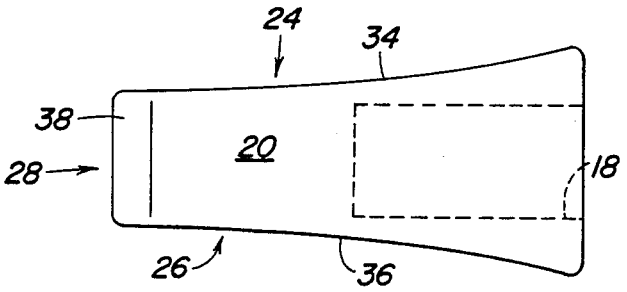
FIG. 2 is a top view of the digging tooth.
Figure 3:
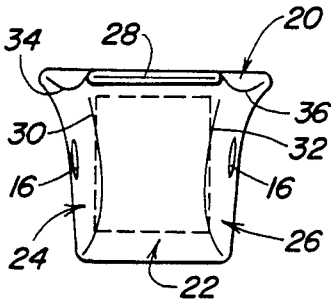
FIG. 3 is a front view of the digging tooth.
Figure 4:
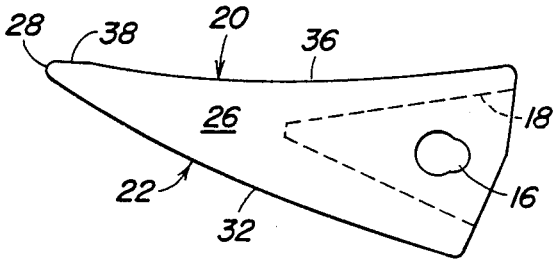
FIG. 4 is a side view of the digging tooth.
Figure 5:
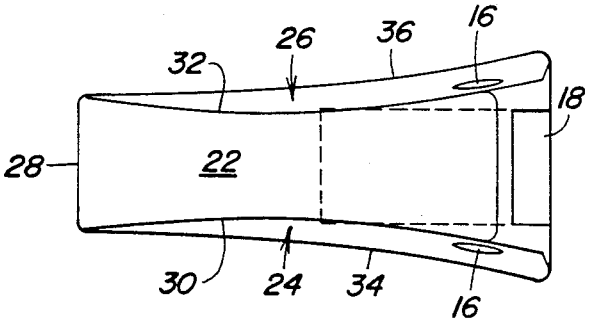
FIG. 5 is a bottom view of the digging tooth.

Excavator or backhoe bucket 10, illustrated in FIG. 1, is provided with a plurality of cutting teeth 12. Bucket 10 is operatively secured to an excavator by linkage 14, only a portion of which is shown. Cutting teeth 12 are secured to the bucket in a conventional manner. A mounting shank 15 is secured to the forward edge of the bucket and is provided with mounting apertures. The cutting tooth is provided with aligned mounting apertures 16 located in both sidewalls of the tooth. The tooth is also provided with a shank receiving cavity 18 located at the rear of the tooth. In mounting the tooth to the bucket, the tooth is mounted over the mounting shank projecting from the bucket and flex pin 17 is inserted through apertures 16 and the aligned apertures in the shank, thereby securing the tooth to the bucket.

The bucket tooth is best illustrated in FIGS. 2–5. The tooth is provided with a concave top surface 20, a convex bottom surface 22 and two concave sidewalls 24 and 26. The top and bottom surface intersect to form forward cutting edge 28. Rear portion 28 of the tooth is provided with mounting means for mounting the tooth to the bucket. The mounting means comprises mounting aperture 16 and shank receiving cavity 18.

The convex bottom surface of the digging tooth approximately conforms to the digging arc of the bucket. As illustrated in FIG. 1, the convex bottom surface is substantially tangential to the bottom surface of the bucket. By having this convex surface, the digging tooth is not fighting itself during a digging operation. Bottom surface 22 is also hourglass shaped as defined by bottom-side edges 30 and 32 formed by bottom surface 22 with sidewalls 24 and 26, respectively. Proceeding from the forward cutting edge to the rear portion of the digging tooth, the bottom surface first converges then diverges creating the hourglass shape.

The concave top surface provides digging relief as it allows material to roll into the hollow formed by the concave surface rather than be compressed by a flat surface. The top surface is also wedge shaped as defined by top-side edges 34 and 36 formed by top surface 20 with sidewalls 24 and 26, respectively. The top surface continuously expands from the forward cutting edge to the rear portion of the tooth. The top portion is also provided with flat surface 38 which forms a wear area for cutting edge 28.

Sidewalls 24 and 26 are moldboard shaped defining concave surfaces. The sidewalls are flattened surrounding aperture 16 to facilitate mounting the tooth to the bucket.

The above described digging tooth should not be limited by the above described embodiment but should be limited solely by the claims that follow.

I claim:

1. A digging tooth for a digging bucket, comprising a top concave surface;

a bottom convex surface intersecting the top surface to form a forward cutting edge;

two moldboard sidewalls extending between the concave top surface and the convex bottom surface, the top surface and the two sidewalls defining two concave top-side edges, the bottom surface and the two sidewalls defining two concave bottom-side edges; and a rear portion extending between the concave top surface, the convex bottom surface and the two sidewalls, the rear portion being provided with mounting means for mounting said digging tooth on a digging bucket, wherein the bottom surface proceeding from the forward cutting edge to the rear portion first converges than diverges, and the top surface proceeding from the forward cutting edge to the rear portion continuously diverges.

* * * * *